United States Patent [19]

Moen

[11] 4,197,789

[45] Apr. 15, 1980

[54] TRAY IN TRAY CONTAINER FORMING

[76] Inventor: Lenard E. Moen, 7914 Michigan, Whittier, Calif. 90602

[21] Appl. No.: 867,767

[22] Filed: Jan. 9, 1978

Related U.S. Application Data

[63] Continuation of Ser. No. 718,129, Aug. 27, 1976, abandoned.

[51] Int. Cl.[2] ..... B31B 15/26

[52] U.S. Cl. ..... 93/51 M; 93/39 R; 93/40; 93/51 R

[58] Field of Search ..... 93/40, 43, 39 R, 55, 93/51 R, 51 M, 47, 36 R, 54.2, 49 M, 49 R

[56] References Cited

U.S. PATENT DOCUMENTS

| | | | |
|---|---|---|---|
| 1,343,748 | 6/1920 | Reifsnyder et al. | 93/40 |
| 1,721,431 | 7/1929 | Claff et al. | 93/40 X |
| 2,154,950 | 4/1939 | MacDonald | 93/39 R |
| 2,977,861 | 4/1961 | Gibb | 93/51 R |
| 3,145,630 | 8/1964 | Moore | 93/51 R |

FOREIGN PATENT DOCUMENTS

| | | | |
|---|---|---|---|
| 2418694 | 10/1975 | Fed. Rep. of Germany | 93/39 R |
| 336004 | 2/1936 | Italy | 93/55 |

*Primary Examiner*—James F. Coan
*Attorney, Agent, or Firm*—Frederick E. Mueller

[57] ABSTRACT

A tray in tray container of corrugated board material is formed from a pair of pre-formed flat body blanks in a bi-level machine having vertically aligned upper and lower dies in which a mandrel reciprocates vertically. The inner body blanks and outer body blanks are stacked in feed hoppers adjacent the upper and lower dies, respectively, and individually stripped out of their respective hoppers into horizontally disposed positions over their respective dies, substantially simultaneously. The feed directions of the two hoppers are right angularly related to one another and glue stripes are applied to each of the body blanks during their transit from the hopper into the corresponding die. Descent of the mandrel initially forms the upper inner body blank into an erect tray configuration within the upper die and continued downward movement of the mandrel drives the completely formed and glued inner box into contact with the flat outer body blank, the latter then being formed and glued around the inner body blank during subsequent passage of the mandrel into the lower die.

19 Claims, 13 Drawing Figures

TRAY IN TRAY CONTAINER FORMING

This is a continuation of application Ser. No. 718,129 filed Aug. 27, 1976, now abandoned.

BACKGROUND OF THE INVENTION

The present invention relates to the forming of corrugated fiber containers and, more particularly, to the automatic forming of laminated double walled containers of a tray in tray configuration.

DESCRIPTION OF THE PREFERRED EMBODIMENT

Figure 1:
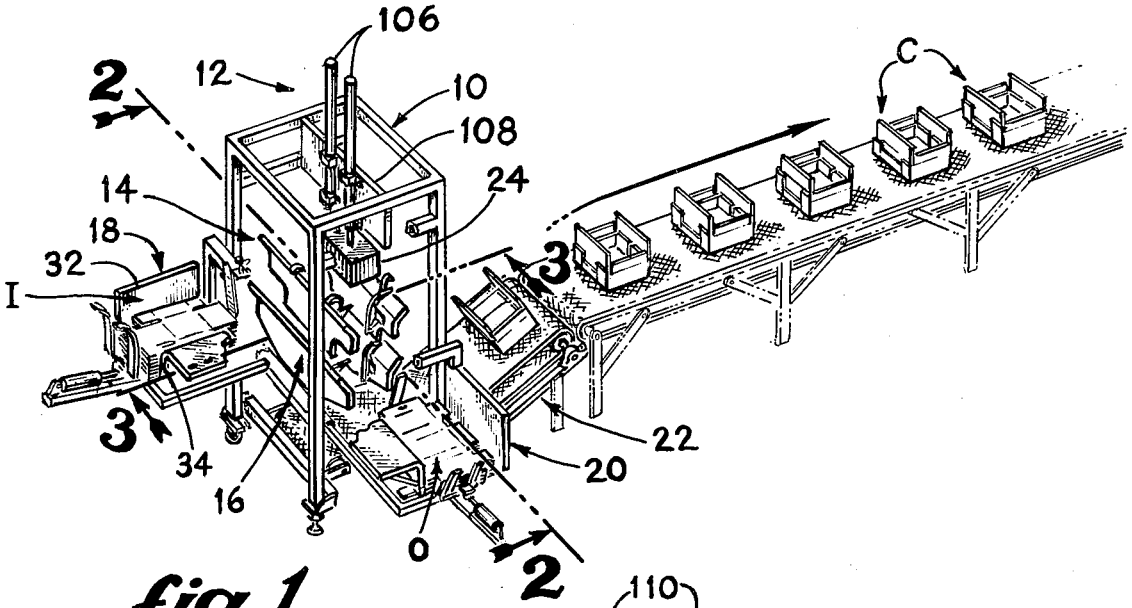
FIG. 1 is a perspective schematic view of a tray in tray container forming machine in accordance with the invention, portions being broken away to better illustrate internal parts.

The general arrangement of the machine is shown in FIG. 1. A vertically elongate rigid framework 10 has a mandrel assembly 12 mounted at its upper end, above an upper die section 14 and a lower die section 16. At one side of the framework 10, adjacent to the upper section 14, a high hopper assembly 18 is connected to the framework to hold a supply of horizontally disposed vertically stacked inner body blanks I. A side of the framework 10 adjacent to the high hopper assembly 18 mounts a low hopper assembly 20, at the level of the lower die section 16, to contain a vertical stack of horizontally disposed outer body blanks O. A discharge conveyer assembly 22 is incorporated in the lower end of the framework 10.

Individual body blanks I and O are individually stripped from the bottoms of the high hopper assembly 18 and lower hopper assembly 20, respectively, immediately thereafter have predetermined skip patterns of hot melt glue applied thereto, and are then arrested in an indexed position above the upper die section 14 and lower die section 16, respectively. A mandrel 24 of the assembly 12 then descends to initially effect tray formation of the inner body blank I in the upper die station or section 14 and, upon continued descent, to form the outer body blank O around the now tray-like inner body I and around the mandrel. As the mandrel withdraws, the completed tray in tray container C is deposited on the discharge conveyer 22, the entire assembly operation being automatic.

Figure 11:
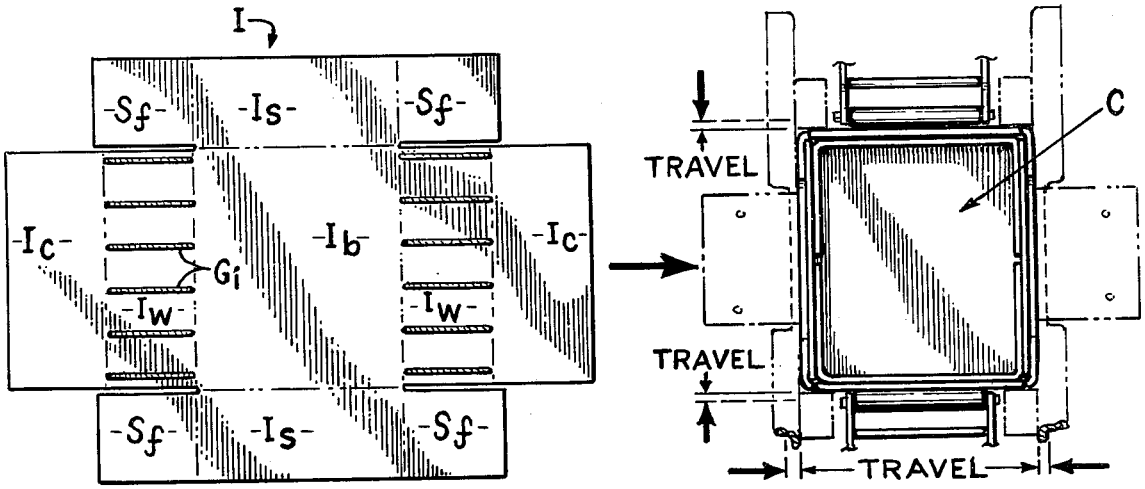
FIG. 11 is a schematic view showing the inner and outer body blanks in plan configuration and the glue stripe patterns therefor and the orientation of their feed directions relative to the working axis of the machine.
Figure 12:
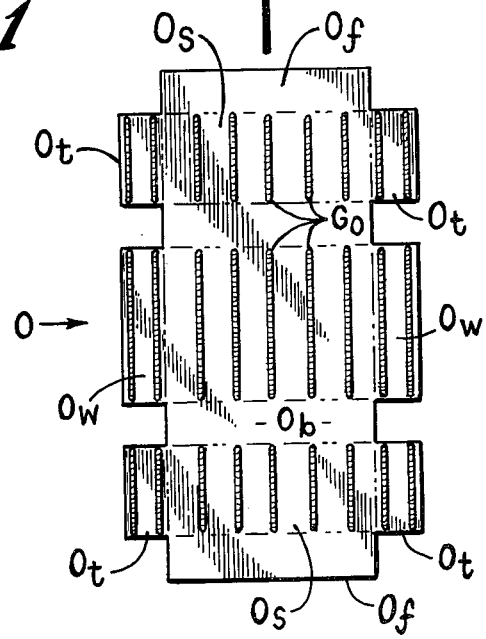
FIG. 12 is a perspective view of a completed tray in tray container, partly sectioned to illustrate the double walled laminated construction thereof.
Figure 12:
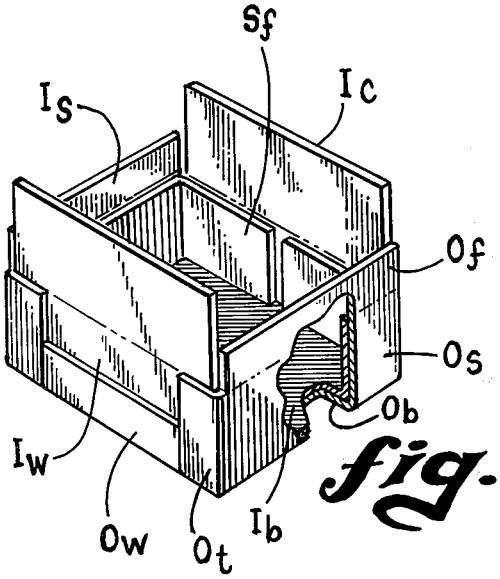
Figure 13:
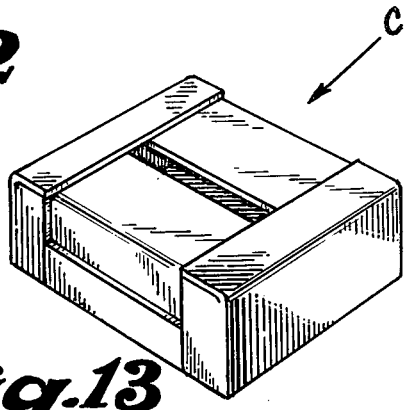
FIG. 13 is a perspective view of the container in top-sealed condition.

More particularly, the inner and outer body blanks, which are typically of corrugated cardboard or fiber board, may have the plan configurations shown in FIG. 11. The completed container C consists of a pair of these two blanks.

The inner body blank I is suitably scored and notched to define relatively foldable areas thereof including a bottom panel area $I_b$. The bottom panel is flanked at opposite sides by side panel areas $I_s$ and each of these, in turn, has opposite end side flaps $S_f$. In the longitudinal direction, corresponding to the feed direction, the inner body blank is flanked by a pair of flaps each divided into a pair of areas comprising end wall portions $I_w$ and outboard cover flap portions $I_c$.

The outer body blank is suitably scored and notched to define a bottom panel $O_b$ that is transversely flanked by a pair of abbreviated wall portions $O_w$. In the longitudinal direction, corresponding to the feed direction of the blank O, the bottom panel $O_b$ terminates in a pair of flaps each divided into a side wall area $O_s$ outboard of which there is a cover flap portion $O_f$. Each of the side wall areas $O_s$ is transversely flanked by a pair of end wall tabs $O_t$.

FIG. 11 also illustrates the skip patterns of beads of hot glue $G_i$ and $G_o$ applied to the blanks I and O, respectively. It should also be observed that the feed directions of the two panels I and O are at right angles to one another. As the pair of body blanks transit from their respective feed hoppers into an indexed position over their respective die cavities, each passes a multi-nozzle glue dispenser resulting in the deposit of the glue beads oriented in the longitudinal feed direction of the blank. With this arrangement, in the completed container C all of the glue beads or stripes $G_i$ and $G_o$ are vertically oriented in the completed container, except for the glue stripes $G_o$ of the outer body blank areas $O_b$ and $O_w$. The completed container C accordingly is greatly superior in resistance to compression loads as compared to laminated containers having horizontally disposed glue stripes in the side wall areas.

Figure 4:
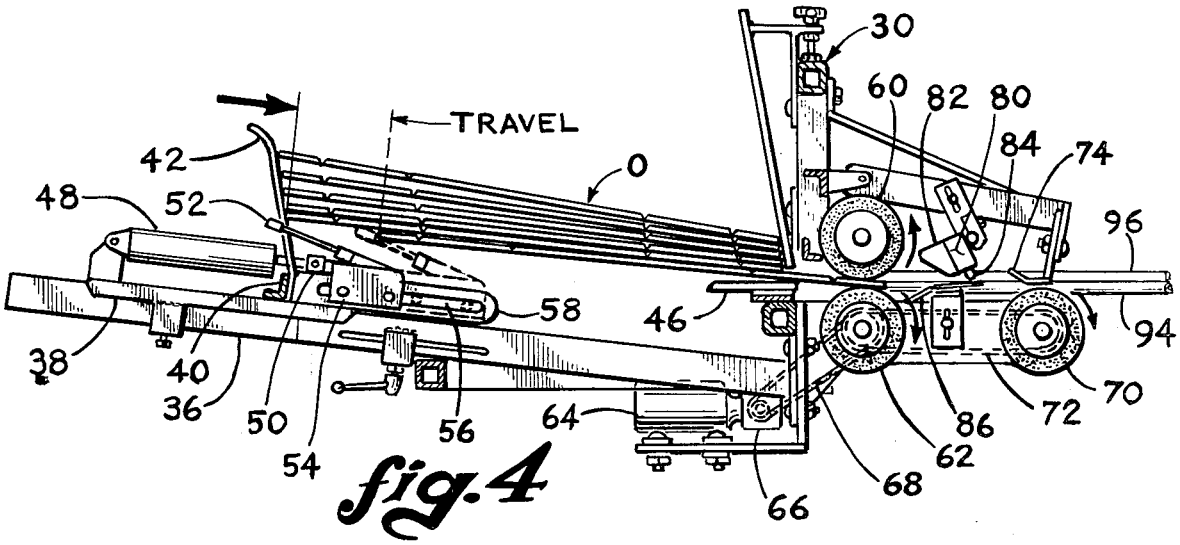
FIG. 4 is a longitudinal vertical elevational view schematically illustrating one of the feed hoppers of the machine.

The manner in which the body blanks are stripped from their hoppers to have glue applied to the upper surface thereof during transit to their respective die cavities is shown in FIG. 4. The illustrated arrangement is typical of both feed hoppers.

The basic machine frame 10 has a sub-frame 30 connected to it which supports the hopper assembly, glue applicators, and blank feeding mechanisms.

The hopper assembly includes a pair of side panels 32, 34 between which a vertical stack of substantially horizontally disposed body blanks, e.g., the blanks O, are received. Suitable floor defining means are provided within the hopper, for example, longitudinal strips secured to the inner surface of each of the side panels on which opposite sides of the stack of body blanks rest. The sub-frame 30 includes a kicker support rod 36 parallel to and midway between the side panels. A bracket 38 secured to the outer end of the support rod 36 rigidly mounts a cross bar 40, opposite ends of which mount a pair of upstanding backstop elements 42 against which the rear edges of the body blanks O slidably bear. A gate for the passage of the bottom one only of the stack of body blanks is centrally defined at the inner end of the hopper assembly by a vertically extending slope bar 44 whose lower edge is spaced above a transversely disposed support shoe 46 a distance about 1¼ times the thickness of the body blank material.

To automatically strip the bottom one of the stack of body blanks, a double acting pneumatic cylinder 48 is top mounted at the outer end of the support rod 36, as on the bracket 38. The inner end of the piston rod of the cylinder 48 is connected to a clevis 50 that is connected to a kicker blade 52. The latter, in turn, is pivotally connected to a slider 54 that is guided for limited reciprocation within the length of a slot 56 of a guide bar 58 secured to and extending along the top of the support rod 36. The cylinder 48 effects reciprocation of the kicker blade 52 within the limited range of reciprocation indicated in FIG. 4 and for each cycle of reciprocation strips off the bottom body panel O.

Inwardly of the hopper, the sub-frame 30 mounts an overhead plurality of co-axially arranged idler guide wheels 60 adapted to bear against the top of the body blank. A co-axial array of drive wheels 62 is mounted in the sub-frame, in opposition to the overhead wheels 60, to bear against the underside of the body blank. An electric motor 64 is coupled to a reduction gear box 66 which, in turn, is drivingly interconnected by a chain and sprocket mechanism 68 to the drive wheels 62.

Longitudinally spaced from the drive wheels 62, that is longitudinally with respect to the feed direction of the body blanks O, is another co-axial array of drive wheels 70 synchronously coupled to the drive wheels 62 by another chain and sprocket mechanism 72. The wheels 70 are also disposed to bear against the underside of the box blank and each of the wheels 70 is mounted in opposition to a corresponding overhead deflection shoe 74. Each shoe 74 is positioned above the corresponding wheel 70 a predetermined gap distance approximately the thickness of the box blank material to bear against the top side of the blank.

In the clear span longitudinal gap between the sets of wheels 62 and 70 the sub-frame 30 mounts a multiple nozzle hot melt glue applicator means 80 to deliver the desired skip pattern of glue stripes $G_i$ or $G_o$ as the case may be. The arrangement is preferably such as is disclosed in my co-pending application, Ser. No. 638,068, now U.S. Pat. No. 3,991,917. Briefly, the glue means comprises a valve body 82 having communication with a source of hot melt glue and mounting a spaced plurality of dispenser nozzles 84, which protrude downwardly to deliver glue onto the top surface of the blank. Each of the nozzles 84 is mounted in opposition to an underside deflection shoe 86 that bears against the underside of the blank. The overhead shoes 74 are each laterally adjusted out of alignment with the nozzles 84 to avoid interference with the glue beads deposited on top of the box blank.

Each of the die sections 14 and 16 is fitted with a pair of material edge guides to support the flat blank I or O, as the case may be, in position above its die cavity preparatory to being folded. Each of the guide elements may take the form of a rod 90 that is anchored at one end in the machine frame 10 by means of a head 92 and having the major portion of its length telescoped within an elongate tube 94, the latter being anchored at the other end of the assembly in the machine frame 10 or the sub-frame 30. A vertically disposed horizontally elongate guide bar 96 is secured to the uppermost longitudinal trace of the tube 94, as by spot welding. Thus, as is shown for the upper die section 14 in FIG. 2, the confronting inner faces of the corresponding pair of guide members 96 are spaced apart a distance corresponding to the distance between inner surfaces of the hopper side panels 32 and 34 to slidably receive the corresponding long edges of the body blanks I. Each of the body blanks I and O is arrested in a stationery, properly indexed position over its corresponding die cavity by a conventional stop member having a material stop switch associated therewith. For example, referring to FIG. 3, a material stop member 100 is fixed in place on the machine frame 10 on the opposite side of the framework from a corresponding drive wheel 70 to stop the upper inner body blank I in indexed relationship relative to the upper die section 14 and mandrel 24. In similar fashion, referring to FIG. 2, a material stop 102 is fixed in place on the framework in opposition to the corresponding drive wheel 70 to index the lower outer body blank O relative to the lower die section 16.

The mandrel assembly 12 comprises a vertically arranged parallel pair of double acting pneumatic power cylinders 106 having their housings securely fixed in place in the upper end of the machine frame 10, as on a suitable cross member 108. The lower ends of piston rods 110 of the power cylinders are fixed to a rigid mandrel framework rigidly carrying mandrel blockers comprising the mandrel 24. It will, of course, be understood, as is conventional, that the mandrel blockers have a horizontal planform and area corresponding to the planform and area of the bottom panel $I_b$ of the inner blank I and a volume approximating that which will be bounded by the inner blank I when erected into tray configuration, as for example in FIG. 8. It will also be understood, as is conventional, that the central vertical axis of reciprocation of the mandrel 24 coincides with the central vertical axis of the upper die section 14 and lower die section 16.

Figure 3:
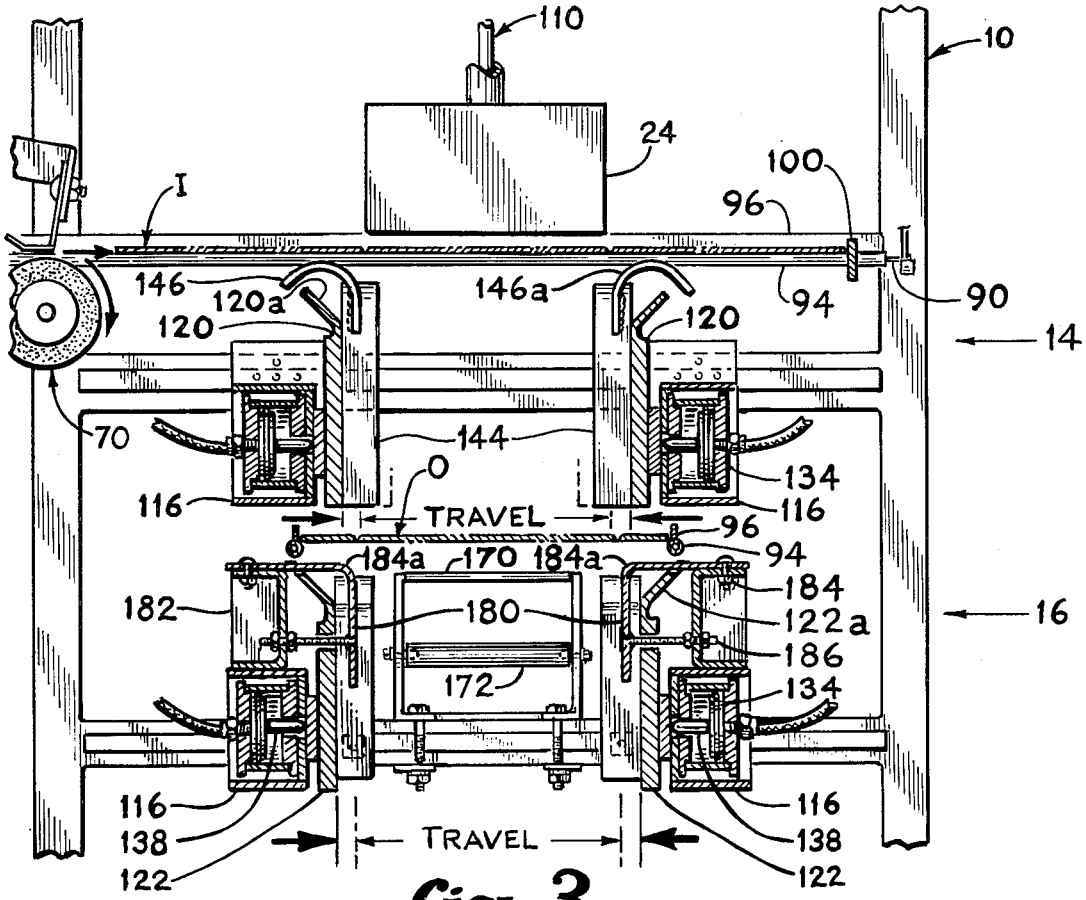
FIG. 3 is a transverse vertical sectional view taken on the line 3—3 of FIG. 1, on a larger scale.

Referring to FIG. 3, the main frame 10 includes an upper die framework and a lower die framework, each comprising a parallel pair of transverse channel beam members 116. The upper die section 14 includes a confronting pair of parallel die plates 120 arranged transversely to the infeed direction of travel of the inner body blank I while the lower die section 16 includes a confronting pair of parallel die plates 122 arranged in alignment with the infeed direction of travel of the lower outer body blank O. Both sets of die plates are mounted on their supporting framework for a limited increment of movement as indicated in FIG. 3. Accordingly, one of the mounting means will be described by way of example.

In order to maintain the die plates in correct vertical and horizontal alignment, each is fitted with a stabilizing yoke slidably carried by the corresponding die framework. Thus, referring to FIG. 7, a horizontal center section 126 of the yoke is fastened to the outer side of one of the die plates 120. At opposite ends of the center section the yoke is provided with a rearwardly extending pair of arms 128 formed with a horizontally extending slot slidably receiving a horizontally spaced apart pair of bearings fastened to a gusset on the corresponding frame member 116. The yoke arms 128 extend with clearance through slots formed in the vertical web of the channel beam 116.

A single acting pneumatic cylinder 134 is secured within the die frame member 116, fitted with a piston 136 connected to a piston rod 138 that projects out of the cylinder through the web of the beam 116, with clearance, to be secured at its external end to the horizontal mid-point of the stabilizing yoke.

As will now be apparent, upon actuation of the pneumatic cylinder 136 the corresponding die plate, e.g., the die plate 120, is thrust inwardly relative to the die cavity for the increment indicated in FIG. 3. Upon release or venting of the pneumatic pressure, the die plate retracts to the solid outline position shown in FIG. 3. Preferably, the return movement of the die plate is spring assisted, as by a pair of springs 139.

Each of the upper die plates 120 is fitted adjacent opposite ends with a pair of corner fold shoes thus defining the four corners of the die cavity. More specifically, referring to FIG. 2, the illustrated upper die plate 120 is formed with an aligned pair of horizontally extending slots 140 to mount a pair of brackets 142 that may be clamped in place on the die plate by means of suitable fasteners. Each of these brackets rigidly mounts a side fold shoe 144 that, in turn, rigidly mounts a corner end flap fold shoe 146.

Figure 2:
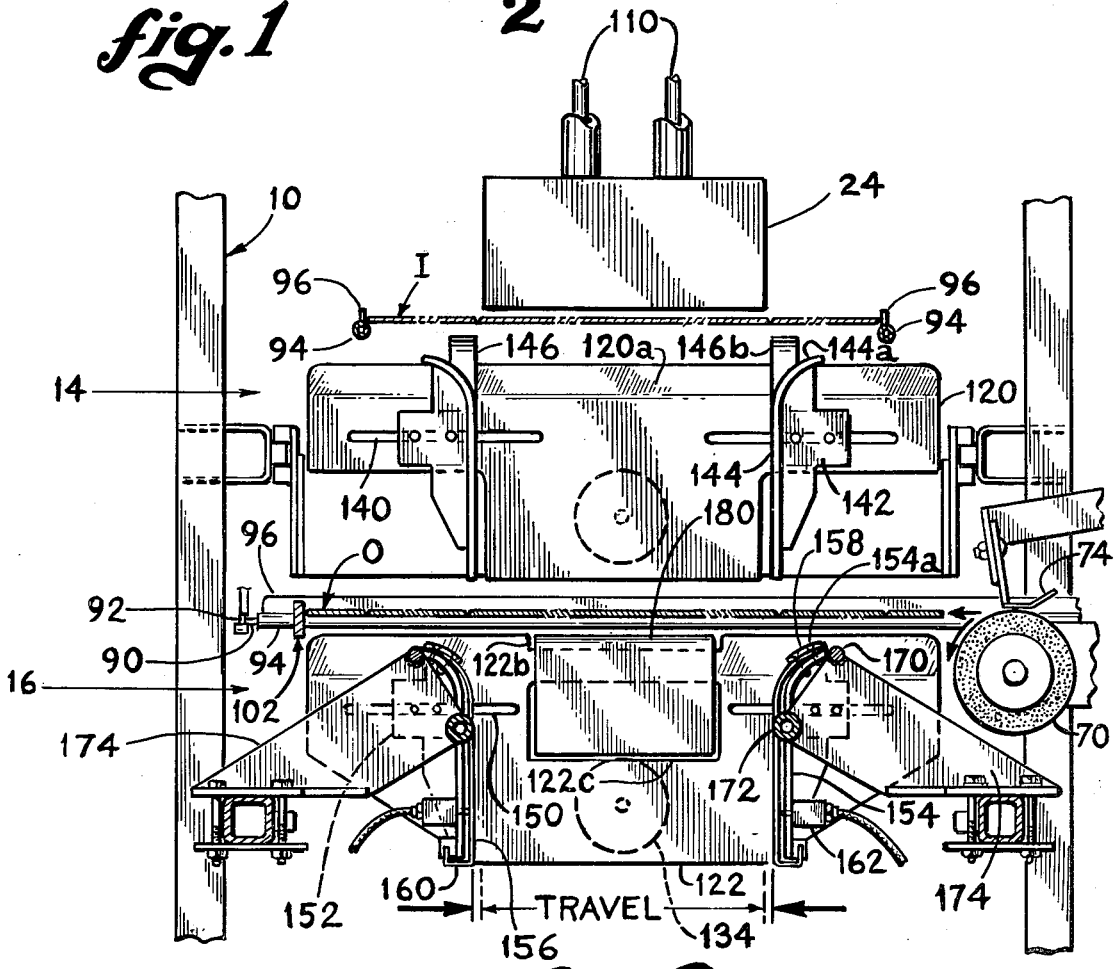
FIG. 2 is a transverse vertical sectional view taken on the line 2—2 of FIG. 1, on an enlarged scale.
Figure 5:
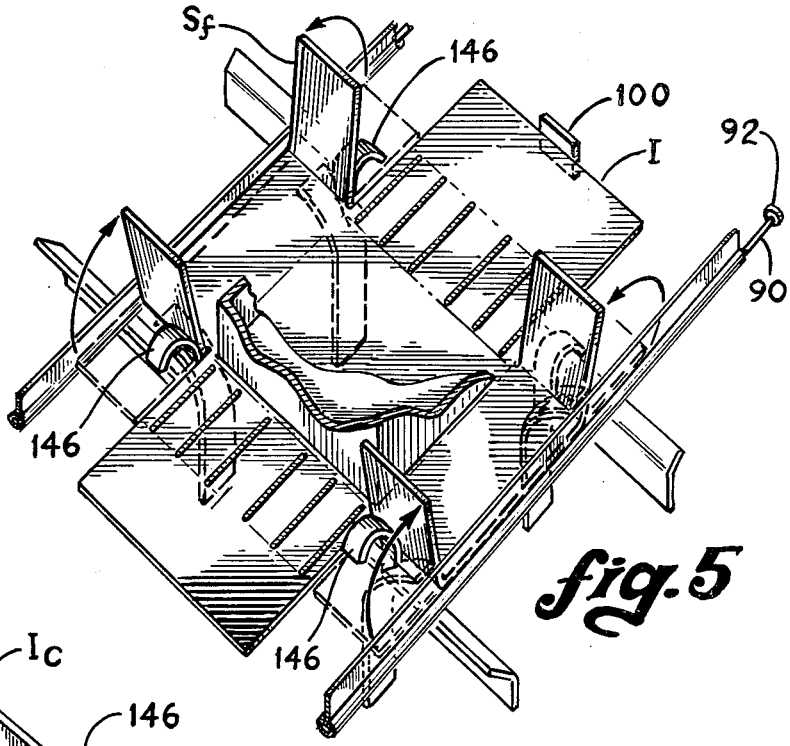
FIGS. 5, 6, and 7 are similar schematic perspective views illustrating a sequence of steps in the erection of an inner body blank into tray configuration within the upper die section of the machine.
Figure 7:
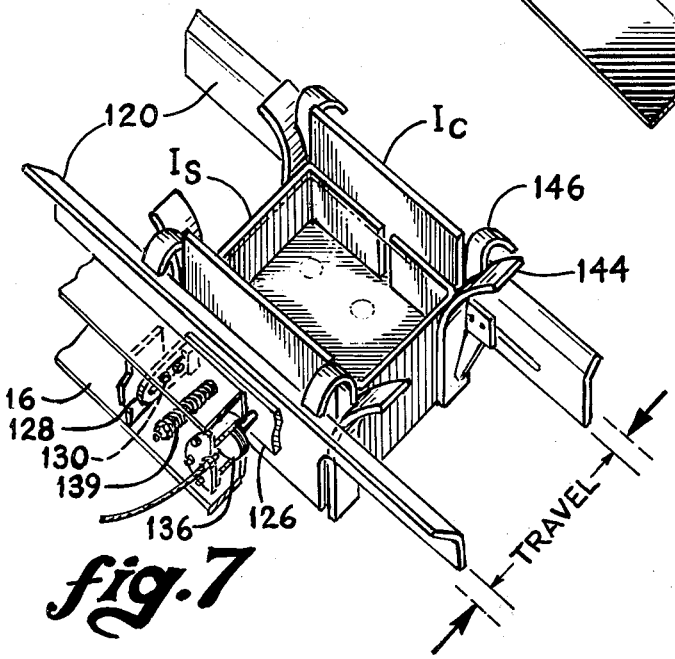
Figure 6:
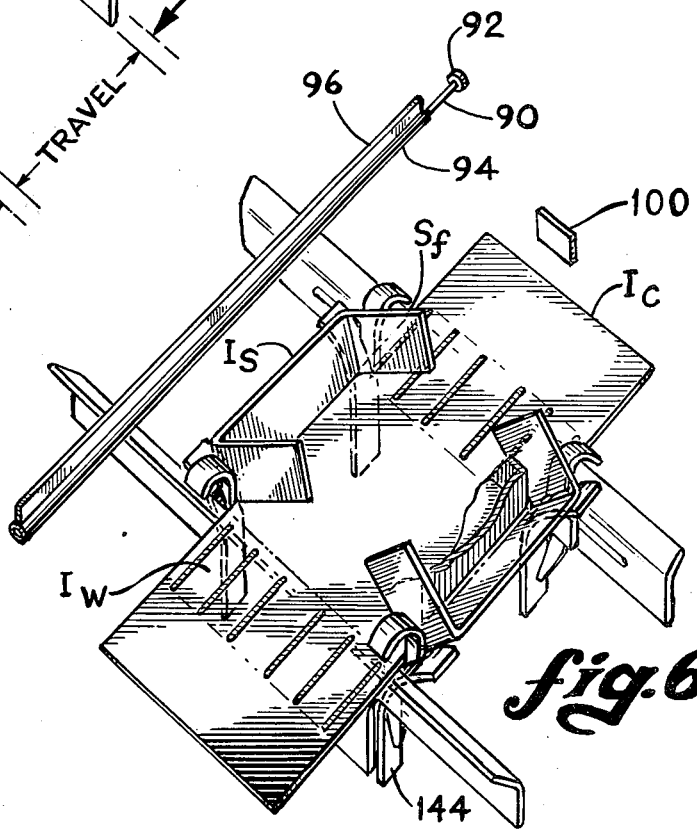

As is shown in FIG. 5, each flap fold shoe 146 is in interfering vertical alignment with an end flap $S_f$ of the blank I and each of these shoes has an upwardly convex camming profile as shown in FIG. 3. As is shown in FIG. 2, the innermost edge 146*b* of each shoe is in vertically flush relationship to the innermost face of a side fold shoe 144. Each of the latter shoes 144 is, in turn, formed at its upper end with an upwardly convex camming surface 144*a* in interfering vertical alignment with one end of one of the pair of the sides $I_s$ of the blank I, as is shown in FIG. 6. As is shown in FIG. 3, the upper edge of each die plate 120 is formed into an upwardly facing cam surface 120*a* which, as is indicated in FIG. 7, is in interfering vertical alignment with one of the flap areas $I_w$ of the blank I. Finally, as is indicated in FIGS. 2 and 3, the upper ends of corner flap fold shoes 146 are spaced beneath the tubes 94 and above upper ends of the cam surfaces 144*a* of the shoes 144. The upper edges of the die plate cam areas 120*a* are in turn spaced beneath the uppermost edges of the cam areas 144*a* of the shoes 144. As will later appear in greater detail, this relationship of the various parts produces the folding sequence indicated in FIGS. 5, 6, and 7.

In the lower die section 16, each die plate 122 is fitted with a pair of side fold shoe assemblies as indicated in FIG. 2. As before, the die plate 122 is formed with a horizontal pair of aligned slots 150 to receive clamp brackets 152 serving as rigid supports for the shoe assemblies. Each of the shoe assemblies comprises a vertically elongate rigid strap member 154 formed at its upper end with an upwardly convex cam surface 154*a* and overlain by a shoe cover made of a conforming piece of spring steel 156. The cover shoe 156 is held in place by a clamp strap 158 at the upper end and is formed at its lower end with a hook portion 160 limiting displacement of the shoe cover 156 relative to its supporting shoe member 154 to the extent indicated in FIG. 2. On its back side each of the support shoes 154 mounts a single acting air cylinder 162 having a piston rod projecting through an opening in the shoe 154 to bear against the inner face of the shoe cover 156. Actuation of a cylinder 162 effects the inward displacement of the shoe cover 156. Release of the air pressure effects spring back of the shoe cover 156 into abutting engagement overlying the corresponding shoe 154.

Figure 8:
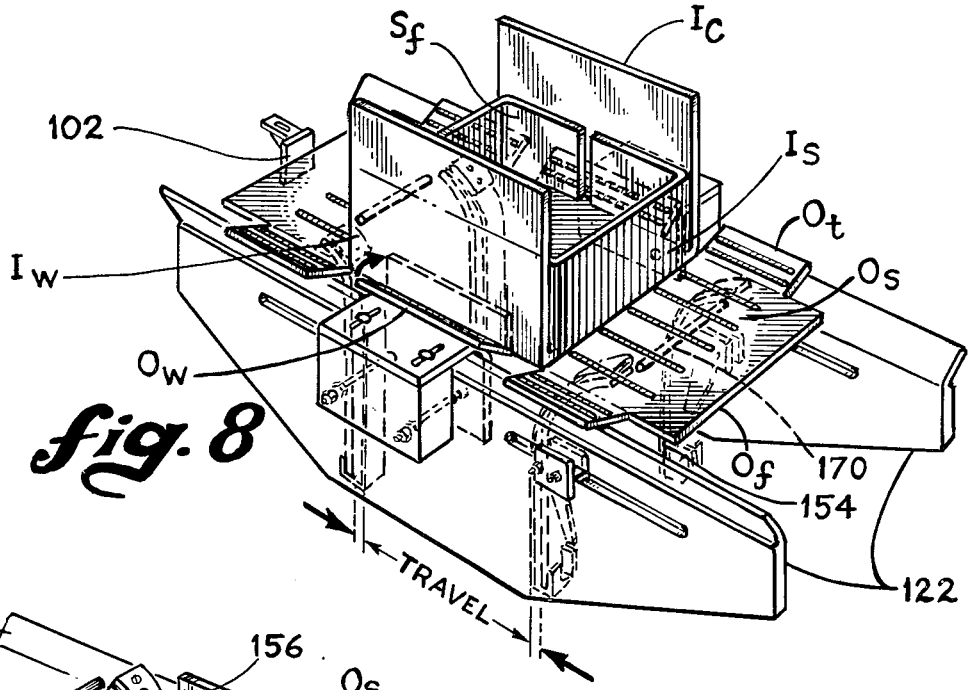
FIGS. 8 and 9 are schematic perspective views illustrating a sequence of steps in the forming of the outer body blank around the inner body blank and mandrel.
Figure 10:
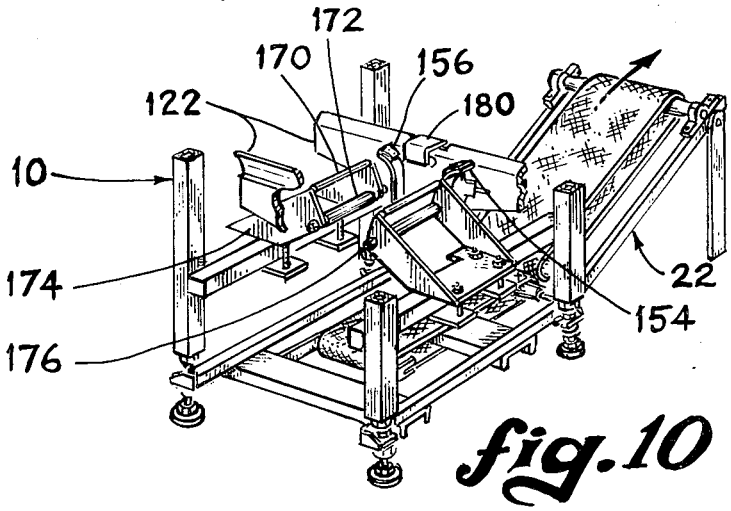
FIG. 10 is a partial perspective view, with portions cut away, illustrating internal mechanisms of the lower die section of the machine just above the discharge conveyer.

Those flaps of the lower, outer body blank O which are to be engaged by the side fold shoe assemblies 154, 156 are also engaged by a horizontal support tube 170 and a horizontal pressure roller 172. As is indicated in FIG. 8, the support tube 170 is in vertically interfering alignment with the plate area $O_s$ of the blank O. As is shown in FIG. 2, each compression roll 172 horizontally spans the distance between a pair of side fold shoe assemblies and has its innermost longitudinal trace essentially tangent with the plane occupied by the inner face of the corresponding shoe cover 156 when the latter is in the inward extended position under the force of the corresponding cylinder 162. As is shown in FIG. 10, each pair of a support member 170 and compression roll 172 may be secured in place by means of a bracket 174 rigidly fixed to the machine frame 10, each bracket horizontally supporting a shaft 176 on which the compression roller 172 is sleeved for rotation.

Each of the die plates 122 of the lower die section is formed along its upper edge into a cam profile 122*a* indicated in FIG. 3. However, as indicated in FIG. 2, this cam profile is interrupted in the mid-portion of the die plate by a clearance notch 122*b* and the vertical face of the die plate is formed with an horizontally elongate clearance recess 122*c*. These clearances provide relief for the mounting of a fold/seal shoe 180. Each of the fold/seal shoes is rigidly mounted in place in the manner shown in FIG. 3, as on an auxiliary die frame member 182. An upper horizontal leg of the fold/seal shoe 180 may be secured to the upper face of the auxiliary frame member by means of fasteners 184 while the vertical leg may be fixed in place by means of a plurality of fasteners 186, each of which extends through the relief slot 122*c* of the corresponding movable die plate 122.

Figure 9:
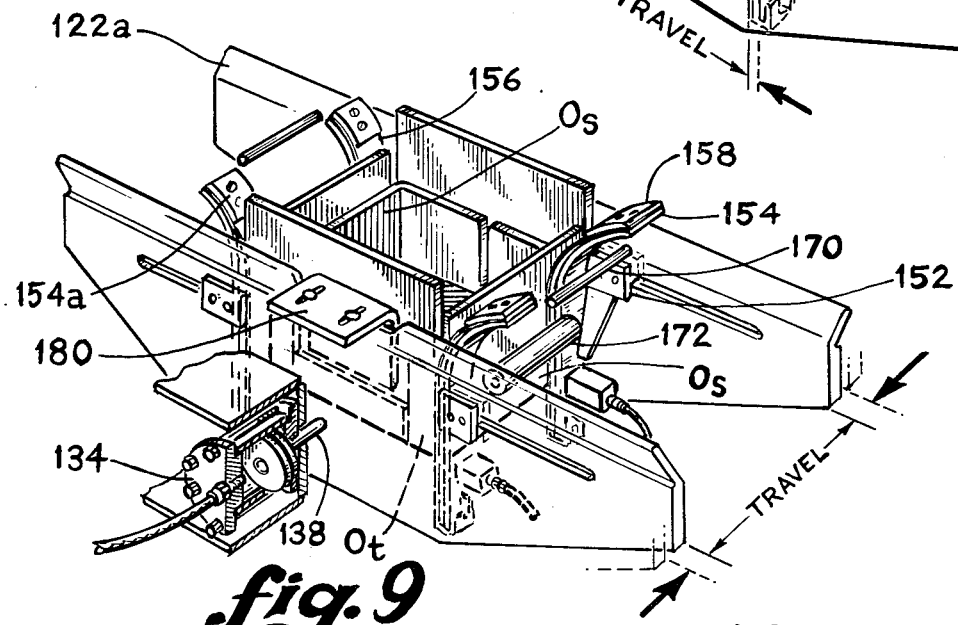

Referring to the profile of the fold/seal shoe 180 shown in FIG. 3, the horizontal and vertical legs merge in a cam profile 184*a* of short radius as compared to the radius of the corresponding die plate 122. The cam 184*a* is vertically spaced below the level of the guide rods 94 and above the cam 122*a*. Referring to FIG. 2, the upper edge of the cam areas 122*a* are, in turn, spaced above uppermost ends of the cams 154*a*. With this relative arrangement the forming steps of FIGS. 8 and 9 are achieved, as will appear in greater detail.

The sequence of operations in automatically assembling a container C from the blanks O and I is as follows.

Upon an extension stroke of the kicker cylinder 48, the bottom one of the blanks O in the high hopper is stripped inwardly by the kicker blade 52 until its leading edge is grabbed by the nip between the wheels 60 and 62. The blank is then driven past the multiple nozzle hot glue applicator 80 to have the skip pattern of glue stripes $G_i$ deposited thereon in the two areas $I_w$ of the body blank. When the leading edge of the blank I hits the stop member 100 it is arrested in an indexed position over the upper die section 14 with its long edges held in place on top of the pair of guide tubes 94 and between the guide bars 96. Simultaneously and in the same manner an outer blank O is stripped out of the low hopper, skip glued, and fed into an indexed position over the lower die cavity. The upper and lower material stops 100, 102 may also have switch elements, the arrangement being such that both switches are closed when both the upper and lower body blanks are against the stops to effect powered descent of the mandrel in a cycle of operation.

The lower face of the mandrel 24 first engages the area $I_b$ of the inner body blank I to effect initial inward folding of the sides $I_s$ between the mandrel and the support tubes 94. The initial folding of the sides $I_s$ carries the end flaps $S_f$ inwardly also, prior to their coming into contact with the corner fold shoes 146. Upon continued descent of the mandrel the corner fold shoes 146 fold the flaps $S_f$ inwardly relative to the sides $I_s$, as is indicated in FIG. 5.

Upon continued descent of the mandrel the sides $I_s$ come into contact with the side fold shoes 144 to be cammed inwardly carrying the end flaps $S_f$ along with them. Substantially concurrently, the camming areas of the die plates 120 effect inward folding of the wall areas $I_w$. When all of the wall portions are erect the upper die plates 120 are moved inwardly by the cylinders 134 which are actuated by a limit switch (associated with the mandrel or the erected upper box) in order to fully erect the walls $I_w$ and to put the glue joints, i.e., now mutually contacting areas of the areas $I_w$ and $S_f$, under compression as the mandrel continues downward.

The upper box now being fully formed, continued descent of the mandrel brings its bottom into registering mutual contact with the area $O_b$ of the outer blank O, the latter being supported in horizontal planar condition by its guide tubes 94, as in FIG. 3. The next increment of downward movement of the mandrel effects initial inward folding of the corner flaps $O_t$ by the lower die plate cam areas 122*a*. As the mandrel continues its descent, the pair of wall flaps $O_w$ engage the short radius cam areas 184*a* of the fold/seal shoes 180. During the next increment of descent of the mandrel the inner vertical faces of the fold/seal shoes 180 force the wall flaps $O_w$ into fully erect intimate contact with the walls $I_w$ of the inner blank. As a result of the action of the fold/seal shoes, the bottom area portion $O_b$ of the outer blank is tensioned and, therefore, held in intimate contact with the mandrel reinforced bottom of the inner blank area $I_b$. The open time of the glue stripes $G_o$ in the areas $O_w$ and $O_b$ of the outer panel is therefore minimized and the two bottom panel areas are successfully adhesively laminated to one another, as are the contacting areas of flaps $O_w$ and $I_w$.

Upon continued descent of the mandrel the side flaps of the outer blank O are folded by the support tubes 170 and the cam areas of the side fold shoes 154, 156 and then fully raised by the pressure rollers 172. As a result the areas $O_s$ and $O_t$ of the outer blank engage confronting areas $L_w$ and portions of $I_s$, respectively, upon which the pair of pneumatic cylinders 134 of the lower die section are actuated to bring the inner vertical faces of the die plates 122 into the planes of the inner surfaces of the pair of fold/seal shoes 180, placing the glue joints under compression. The lower die cylinders 134 are actuated by another limit switch (for example, one actuated by a cam on the mandrel) prior to or during the final increment of movement downward of the mandrel into the lower die, as are the air cylinders 162 for the shoe covers 156. As the mandrel withdraws from the fully formed container, the air loaded shoes 156 retract, the pairs of die plates 120 and 122 are retracted, and the completed container drops onto the discharge conveyer 22.

While the invention has been shown and described in what is presently conceived to be its most practical and preferred embodiment it will be recognized that departures may be made therefrom within the scope of the invention.

I claim:

1. The method of forming a tray in tray container from a flat inner body blank and a flat outer body blank, the inner body blank having a bottom panel with an opposite pair of end wall portions, an opposite pair of side wall portions and a pair of marginal side flaps at opposite ends of each side wall portion, the outer body blank having a bottom panel and at least an opposite pair of wall portions on opposite sides of the bottom panel, said method including:

applying adhesive to the opposite side wall portions of the inner body blank;

relatively moving a mandrel and a first die means to form the inner body blank into an erected tray configuration around the mandrel with the bottom panel portion of the inner body blank in contacting registration with a bottom face of the mandrel and with an opposite pair of laminated end walls comprising the pair of opposite end wall portions and the marginal flaps of the side wall portions;

applying adhesive to the inside of the bottom panel of the outer blank, moving the inner tray carrying mandrel into contacting registration of the bottom panel area of the inner tray onto the glue bearing surface of the bottom panel of the outer blank;

and erecting the wall portions of the outer blank around and onto corresponding walls of the previously erected inner tray by relative movement of the mandrel, inner tray and outer body blank and a second die means.

2. The method of claim 1 in which transverse tension is induced in the bottom panel of the outer body blank by the erecting of the opposite pair of the wall portions of the outer body blank.

3. A machine for forming a tray in tray container from an inner body blank and an outer body blank comprising:

a main frame mounting an axially reciprocable mandrel;

first and second axially open-ended die means centered on and spaced apart along the axis of reciprocation of said mandrel;

said mandrel and said first die means co-acting during entry of said mandrel into said first die means to sequentially erect different wall and flap portions of the inner body blank around said mandrel and into mutual contact of glue joint areas of overlapping wall and flap portions of the inner body blank;

said mandrel and said second die means co-acting during entry of said mandrel into said second die means to erect the walls of the outer body blank around the now erect formed walls of the inner body blank and into mutual contact of glue joint areas of wall portions of the inner and outer body blanks;

said second die means including means for tensioning a bottom panel area of the outer body blank against a bottom panel area of the inner body blank and both bottom panel areas against a bottom area of said mandrel during initial entry of said mandrel into said second die means.

4. The machine of claim 30 in which said first die means and said second die means each includes an opposed spaced apart parallel pair of die plates oriented parallel to said axis of reciprocation, each pair of said die plates being mounted for limited extension and retraction inwardly and outwardly of the corresponding die means, and a power means for each of said pair of die plates for effecting inward extension of said die plates during entry of said mandrel therebetween.

5. The machine of claim 4 in which said tensioning means comprises a confronting spaced pair of fold/seal shoes normally overlying the pair of movable die plates of said second die means, each of said fold/seal shoes having an inner face for bearing against a fully erected flap of the outer body blank, each of said die plates of said second die means having a fully inwardly extended position in which its inner face is co-planar with the inner face of the corresponding one of said fold/seal shoes.

6. The machine of claim 5 in which each of said die plates of said second die means has an entry edge portion comprising a cam, and each of said fold/seal shoes has an entry edge portion comprising a cam parallel to said entry edge of the corresponding one of said die plates, each of said fold/seal shoe cams having a radius shorter than the radius of said entry edge of the corresponding one of said die plates.

7. A machine for forming a tray in tray container from a pre-formed flat inner body blank and a pre-formed flat outer body blank comprising:

a frame;

a mandrel of rigidly fixed planform dimension mounted on said frame for axial reciprocation;

first and second die means centered on and spaced apart along the axis of reciprocation of said mandrel;

each of said first and second die means having sides in progressively stepped interfering alignment with different wall and flap portions of the inner body blank and outer body blank, respectively, and each of said die means defining a pair of opposite end openings for receiving bottom panel portions of the inner body blank and outer body blank, respectively, and for unimpeded reciprocation of said mandrel in said openings of said first and second die means;

said mandrel being adapted for said reciprocation through both said die means to completely form said container in a single cycle of reciprocation of said mandrel along said axis;

means for indexing a flat inner body blank in centered position of a bottom panel of the blank over said opening of said first die means;

means for indexing a flat outer body blank in centered position of a bottom panel of the blank over said opening of said second die means;

said mandrel and said first die means comprising co-acting means responsive to entry of said mandrel into said opening of said first die means to (a) progressively erect different wall and flap portions of the inner body blank around said mandrel and (b) to contract into mutual contact the glue joint areas of overlapping wall and flap portions of the inner body blank to make an erected and glued inner tray embracing and carried by said mandrel in continued movement towards said second die means;

said mandrel and said second die means comprising co-acting means responsive to entry of said inner tray carrying mandrel into said opening of said second die means to (a) progressively erect different wall portions of the outer body blank around the walls of the inner tray carried on said mandrel and (b) to contract into mutual contact the glue joint areas of overlapping wall portions of the inner and outer body blanks to make an outer tray laminated to the inner tray.

8. The machine of claim 7 wherein each of said die means defines a rectangular opening for the reciprocation of said mandrel therein.

9. The machine of claim 8 in which said sides of each of said die means comprises a spaced apart parallel pair of die plates oriented parallel to said axis of reciprocation of said mandrel.

10. The machine of claim 9 wherein each pair of said die plates is mounted for limited extension and retraction inwardly and outwardly of the corresponding die means, and a power means for each of said pair of die plates for effecting inward extension of said die plates during entry of said mandrel therebetween.

11. The machine of claim 9 in which each of said die plates has a spaced pair of corner fold shoes secured thereto to define, in each of said die means, the four corners of the die cavity with the corresponding pair of said die plates.

12. A machine as in claim 11 in which said fold shoes of said second die means are each fitted with a shoe cover overlying the inner face of said fold shoe and mounted on said fold shoe for a limited extension and retraction inwardly and outwardly of said second die means, each of said shoes of said second die means having a power means effective to extend and retract the corresponding one of said shoe covers during entry of said mandrel into said second die means.

13. The machine of claim 9 in which each of the sides of said second die means adjacent to one of said pair of die plates includes a stationary support tube and a stationary compression roll, said support tube being located in interfering alignment with a flap of the outer body blank to erect the flap as the outer body blank is pushed through said second die means, said compression roll having an inner face positioned to bear against the fully erected flap.

14. The machine of claim 13 in which each of said die plates has a spaced pair of corner fold shoes secured thereto to define in each of said die means the four corners of the die cavity with said die plates, each of said fold shoes of said second die means being fitted with a shoe cover overlying the inner face of said fold shoe and supported on said fold shoe for limited extension and retraction inwardly and outwardly of said second die means, each of said shoes of said second die means having a power means effective to extend and retract the corresponding one of said shoe covers during entry of said mandrel into said second die means, said shoe covers in fully extended position occupying a common plane with an inner face of the corresponding one of said compression rolls.

15. The machine of claim 8 having:

means for feeding a pre-glued inner body blank into a flat indexed position above an upper end of said first die means, and means for feeding a pre-glued outer body blank into a flat indexed position above an upper end of said second die means.

16. The machine of claim 15 in which both said means for feeding blanks include a glue applicator means to deposit beads of glue on the surface of the blank in a direction parallel to the in-feed direction.

17. The machine of claim 15 in which said means for feeding the inner body blanks and said means for feeding the outer body blanks have feed directions that are right angularly related to one another.

18. The machine of claim 15 in which said sides of said first die means and said second die means each comprise a spaced apart parallel pair of vertically disposed die plates oriented at right angles to the infeed direction of the corresponding one of said means for feeding the inner or outer body blanks.

19. The machine of claim 18 in which said means for feeding the inner body blanks and said means for feeding the outer body blanks have feed directions that are right angularly related to one another.

* * * * *